US005602930A

United States Patent [19]

Walton

[11] Patent Number: 5,602,930

[45] Date of Patent: Feb. 11, 1997

[54] LOUDSPEAKER

[75] Inventor: Roger N. Walton, Nr. Barry, Great Britain

[73] Assignee: Harman-Motive Limited, Great Britain

[21] Appl. No.: 367,199

[22] PCT Filed: Jul. 16, 1993

[86] PCT No.: PCT/GB93/01509

§ 371 Date: Jan. 9, 1995

§ 102(e) Date: Jan. 9, 1995

[87] PCT Pub. No.: WO94/03024

PCT Pub. Date: Feb. 3, 1994

[30] Foreign Application Priority Data

Jul. 17, 1992 [GB] United Kingdom ..... 9215222

[51] Int. Cl.[6] ..... H04R 25/00

[52] U.S. Cl. ..... 381/192; 381/186; 381/197

[58] Field of Search ..... 381/156, 182, 381/184, 185, 186, 192, 194, 197, 199, 202; 181/152, 192, 193, 194, 195, 199

[56] References Cited

U.S. PATENT DOCUMENTS 4,965,839 10/1990 Elieli ..... 381/192

FOREIGN PATENT DOCUMENTS 545712 6/1942 United Kingdom .

*Primary Examiner*—Curtis Kuntz
*Assistant Examiner*—Huyen D. Le
*Attorney, Agent, or Firm*— Barnes & Thornburg

[57] ABSTRACT

A loudspeaker has a pole (6) and a surrounding magnet (3) which together define an annular gap (7). A voice coil (12) supported on a tubular former (8) is disposed within the gap (7) as is a conductive skirted dome (13). The dome (13) is supported upon an insulating gasket (14) providing three arcuate points of support and a phase plug (16) extends through a central opening (15) in the dome (13). The dome (13) and phase plug (16) are preferably separated by a second gasket (27) which may or may not be bonded to both and the phase plug (16) suitably includes an integral horn (20) extending beyond the former(8).

15 Claims, 2 Drawing Sheets

FIG. 1.
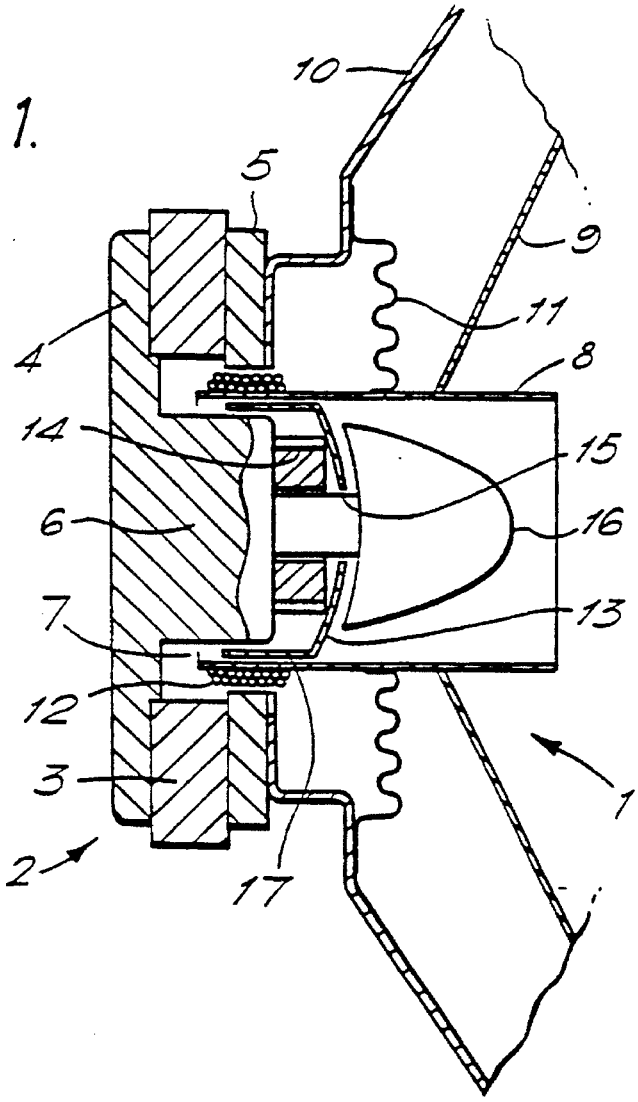
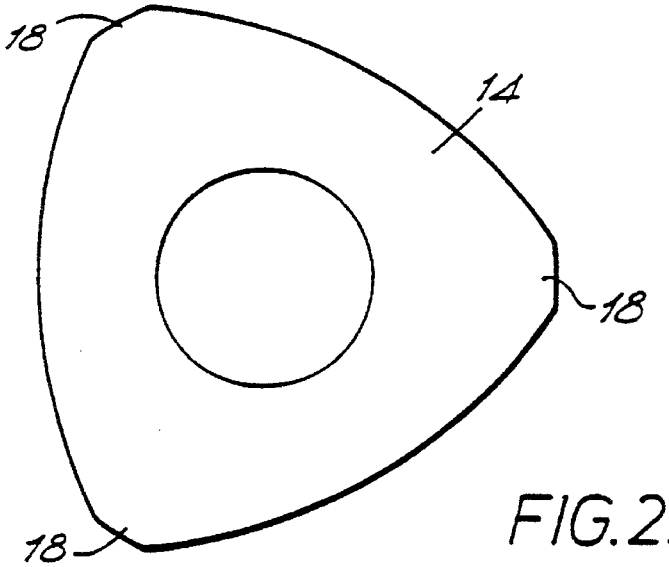
FIG. 2.

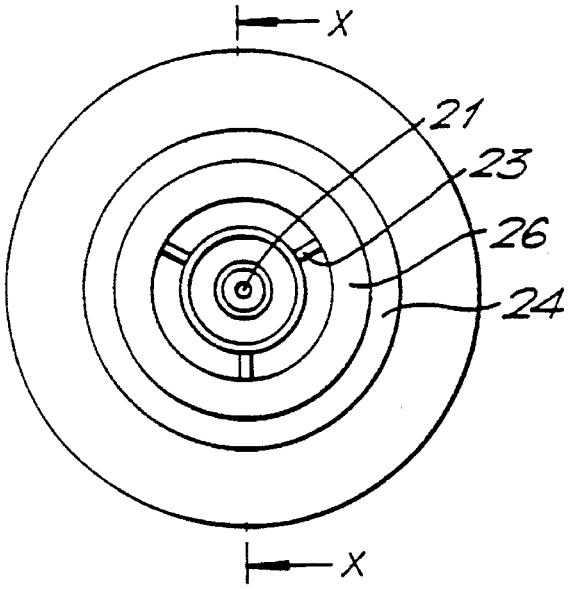
FIG.3A.
FIG.3B.
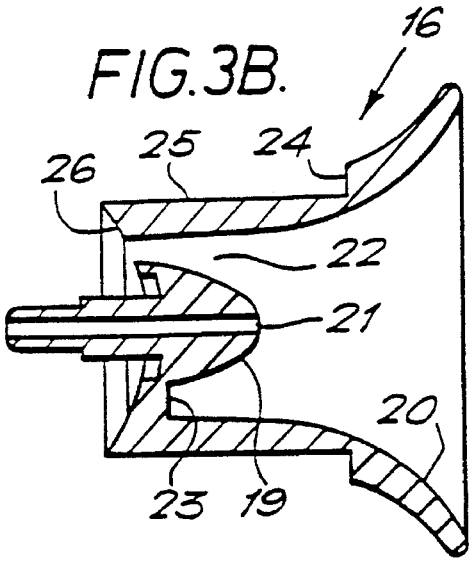
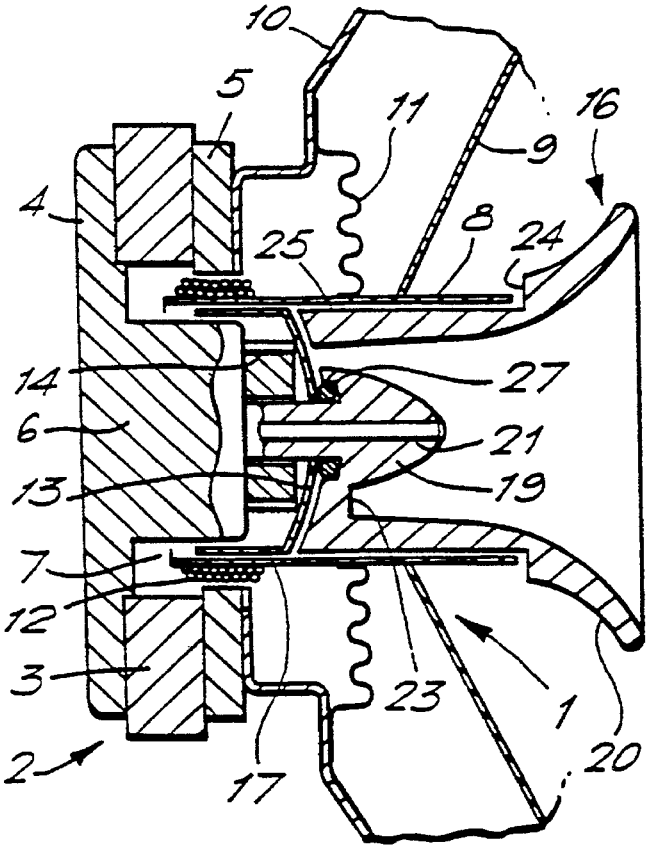
FIG.4.

LOUDSPEAKER

FIELD OF THE INVENTION

This invention relates to a loudspeaker incorporating an inductively coupled tweeter particularly, but not necessarily only, for use in an automotive audio system.

Background op the Invention

Description of the Prior Art

A loudspeaker conventionally comprises a magnet assembly with an annular gap having a radial magnetic field within the gap. A voice coil is suspended in the magnetic field by means which permit it to be moved axially without touching the sides of the magnet assembly. The voice coil is wound on a rigid tube that is connected to a diaphragm, the outer edge of which is flexibly supported by a frame that is itself securely attached to a part of the magnet assembly. However, with this type of loudspeaker the frequency range of the sound produced is limited to low and medium frequency and, in order to reproduce high frequency sounds, it is proposed to incorporate an inductively coupled tweeter.

Inductively coupled tweeters in loudspeakers are known. For example, GB 545712 discloses an inductively coupled conductor in the form of a radiating dome positioned in the magnetic gap inside the main voice coil of a loudspeaker. The low and medium frequency sounds are radiated by a conventional cone, the high frequency sound is produced by he dome and is directionally controlled by a special horn fixed to the centre pole.

In U.K. Patent No. 2118398 a similar arrangement is disclosed where a radiating dome is positioned over he central pole and supported by an annular suspension means. The dome is positioned within he tube or former supporting he voice coil and receives is energizing signals inductively from he voice coil. The dome is horn loaded by the same diaphragm as the voice coil, reproduces high frequency sound.

More recent proposals are contained in European Published Applications 0344974 and 0344975. European Publication 0344974 is an improvement on the loudspeaker disclosed in GB Patent No. 2118398 and includes a fixed element providing phase correction, which is supported by he pole through a hole in he dome. The radiating dome is supported by an annular flexible suspension on the pole face and also by another smaller flexible suspension on the underside of the phase correcting device. This provides two mall sealed chambers. On the free end of the former there is a flared extension which is designed to provide a smooth acoustic impedence transition.

European Publication No. 0344975 discloses a similar electro acoustic transducer as disclosed in GB Patent No. 2188398 but is directed to the provision of an electrically insulating layer between the dome and the centre pole. This allows the annular gap to be of a minimum clearance whilst eliminating short circuiting between the pole and the dome.

SUMMARY OF THE INVENTION

An object of the present invention is to provide an improved loudspeaker with an inductively coupled tweeter.

According to the present invention, there is provided a loudspeaker comprising a pole, a surrounding magnet defining an annular gap with the pole, a tubular former, a voice coil carried by the former and disposed within the annular gap, and a conductive skirted dome supported on the pole upon an insulated support with the skirt disposed in the annular gap so as to be inductively coupled with the voice coil when the voice coil is energized, characterized in that the insulated support provides a plurality of spaced positions of support.

Preferably, the dome is supported upon three arcuate points of support. The three points of support may be provided by a gasket shaped to provide the arcuate points of support. The conductive dome suitably includes a central opening with a clearance to receive a phase plug attached to the pole by a stem passing through the opening. The underside of the phase plug may include a second gasket around its central supporting peg, to which the dome may or may not be bonded, to limit travel of the dome and to ensure that the skirt is always located in the annular magnetic gap. The reduction of support for the dome by using a pole face gasket having three arcuate points of support instead of a complete circle effectively reduces the suspended mass and improves performance of the tweeter. The phase plug may include a horn extending beyond the former.

In one embodiment of the invention the dome for forming the inductively coupled tweeter in the loudspeaker may comprise an electrically conductive skirt and an insulated domed portion to generate high frequency sound. The insulated dome portion may be selected from a non-electrically conductive material such as paper or plastics material or an electrically conductive material such as aluminium but insulated from the skirt.

BRIEF DESCRIPTION OF THE DRAWINGS

The invention will new be described by way of example with reference to the accompanying drawings in which:

FIG. 1 is a diagrammatic section of a loudspeaker in accordance with the invention;

FIG. 2 is a plan view of the supporting gasket in FIG. 1;

FIGS. 3*a* and 3*b* show respectively a plan view and side section of a preferred form of phase plug in accordance with the invention; and, FIG. 4 is a diagrammatic section showing an embodiment of the invention including the phase plug of FIG. 3.

DETAILED DESCRIPTION OF THE DRAWINGS

In FIG. 1, a loudspeaker 1 comprises a conventional back assembly 2 consisting of a magnet ring 3 having a yoke and an annular front plate 5 bonded to the magnet ring 3. The yoke 4 includes a cylindrical pole 6 extending through the openings defined by the annular plate 5 and the magnet ring 3 to define an annular gap 7. A hollow cylindrical former 8 is arranged to extend concentrically over a free end of the centre pole 6and to lie partly within the annular gap 7 and a diaphragm 9 is bonded to the former. The former 8 and the diaphragm 9 are mounted to a fixed chassis 10 by means of a flexible suspension 11. A voice coil 12 is wound over the former and lies within the annular gap 7.

In order to reproduce high frequency sounds an inductively coupled tweeter is included which consists of an alumimium dome 13 supported within the gap 7 upon a gasket 14 providing three arcuate spaced positions of support. The dome 13 is inductively coupled to the voice coil 12 and includes a central aperture 15 through which a fixed phase plug 16 is mounted within the former 8.

The dome 13 is a one piece aluminium foil dame with a skirt 17 that is located in the annular magnetic gap 7 inside the main voice coil 12. The dome 13 is free to vibrate but is supported on the gasket 14 which is a compliant gasket bonded to the end face of pole 6. As can be seen from FIG. 2, the gasket is of such a shape that it will make contact at approximately three equally spaced arcuate positions 18. The gasket suspension allows the dome 13 to float free with the minimum of support from the gasket 14.

In use, when an electrical signal is applied to the voice coil 12, forces are set up which move the former 8 and diaphragm 9 to produce low and medium frquency sound in accordance with the signal input. High frequency sound is produced by the dome 13 which, when the signal is applied to the voice coil 12, vibrates by virtue of the inductive coupling to the skirt 17 of the dome. The sound is radiated by means of the dome surface between the phase plug 16 and the former 8. The phase plug is an established way of preventing radiation from the central part of the dome interfering with that from the edge.

By providing a supporting gasket with only three positions of support the attachment of mass is minimised which improves performance of the inductively coupled tweeter. The positions of support 18 defined by the outermost part of the gasket 14 are disposed radially inwardly of the edge of the pole 6. This arrangement supports the dome 13 just above the radius on the pole edge so that the dome 13 does not buzz or touch the pole in operation.

The dome 13 may be supported at more or less spaced positions and the positions need not be equally spaced. The dome may or may not be actually bonded to the gasket by self adhesive or other means. The gasket may be bonded or located concentrically on the face of the pole 6. If desired a second soft gasket (not shown in FIG. 1) may be provided around the underside of the phase plug 16 to gently retain the dome 13 in the correct position touching either in a circle of contact or in several places only. The second gasket may or may not be bonded to the date 13. If the second gasket is bonded to the re 13 as well as to the underside of the phase plug 16 the gasket secures the dome 13 so that it is not free-floating but the material of the dome 13 allows it to flex in use.

The phase plug 16 suitably has an underside radius that is very similar to the dome 13 in order that it can fit closely although there may be a recess in the underside to locate the second soft gasket in position if provided. If desired the inside of the dome 13 or the outside of the pole 6 may be insulated in accordance with normal established electrical practice with conductors adjacent to other metal parts to prevent the dome 13 shorting on the pole 6.

In one arrangement of the invention the former 8 may be provided with a conventional paper whizzer (not shown) for acoustical matching purposes to radiate the higher frequencies produced by the tweeter and voice coil.

The phase plug may include a separate or integral horn as shown in FIGS. 3*a* and 3*b*. In that arrangement the phase plug 16 includes a central phase correction portion 19 and a horn portion 20. The central portion 19 may have a centre hole 21 to allow fixture to the pole 6. The horn portion 20 is spaced from the central portion 19 to define a sound throat 22 and is fixed in position by three or more thin webs 23 connecting the horn portion 20 to the central portion 19. The horn portion 20 is flared outwardly and, on its outer surface, includes an annular shoulder 24 dimensioned to provide an annular rebate 25 which receives the moving free end of the former 8. The inner end surface 26 of the horn portion 20 is curved as shown to conform substantially with the curved surface of the dome 13. The arrangement is shown in section in FIG. 4 with a second gasket 27 bonded to both the dome and underside of the phase plug.

In use, low and medium frequency sound is rated by the diaphragm 9 and high frequency sound generated by the inductively coupled dome 13 is amplified and directionally controlled by the sound throat 22 of the horn portion 20. Because the outer surface of the horn portion 20 co-operates with the free end of the former 8 and the shoulder 24 will be aligned with the free end of the former 8 there is no sound passage between the outer surface of the horn portion 20 and the former 8 so that the high frequency sound produced by the dome 13 is all directionally radiated by the flared surface of the horn portion 20. The horn portion 20 is not attached in any way to the former 8 and, being preferably integral with the phase correction portion 19, provides stable acoustical matching and reduced mass compared with a horn attached to the moving former 8.

Although in FIGS. 3*a* and 3*b* the central portion 19 and horn portion 20 are shown as integrally moulded they may be separate if desired. The reduced line of support by using a 3-point suspension gasket on the pole face reduces the suspended mass and allows the dome to reproduce with a smoother frequency response and with improved sensitivity.

In the preferred arrangement the dome 13 is described as a one piece aluminium foil dome. However, in order to prevent the induced current from shorting across the dome, the skirt 17 may be conductive with a non-conductive paper or plastic curved top surface.

I claim:

1. A loudspeaker (1) comprising a pole (6), a surrounding magnet (3) defining an annular gap (7) with the pole, a tubular former (8), a voice coil (12) carried by the former (8) and disposed within the annular gap (7), a conductive skirted dome (13), an insulated support (14) between the dome (13) and the pole (6), the insulated support (14) supporting the dome on the pole, said skirt being disposed within the annular gap (7), whereby, when the voice coil is energized, the conductive skirted dome is inductively coupled with the voice coil, and the insulated support (14) comprising a plurality of discrete, separated and spaced apart positions of support (18) between the dome (13) and the pole (6).

2. A loudspeaker according to claim 1 wherein the dome (13) is supported on the pole (6) upon three spaced positions of support (18).

3. A loudspeaker (1) according to claim 1, wherein the dome is supported upon three spaced positions of support (18), said spaced positions are arcuate and are provided by a shaped gasket (14).

4. A loudspeaker (1) according to claim 1, wherein a gasket (14) is secured to the inside of the dome (13), said gasket providing three spaced arcuate positions of support.

5. A loudspeaker (1) according to claim 1, wherein the dome (13) is a one piece aluminum foil.

6. A loudspeaker according to claim 1, wherein the dome (13) comprises an electrically conductive skirt and an insulated domed portion to generate high frequency sound.

7. A loudspeaker (1) according to claim 1, further including a phase plug (16), the phase plug (16) having a stem attached to the pole (6), the dome (13) including a central opening (15) through which the stem passes with a clearance.

8. A loudspeaker (1) according to claim 1, further including a phase plug (16) attached to the pole (6) through a central opening (15) in the dome (13), the phase plug (16) including a horn (20) extending axially and laterally beyond the former (8) and an annular recess (25) for allowing room for movement of the former.

9. A loudspeaker (1) comprising a pole (6), a surrounding magnet (3) defining an annular gap (7) with the pole, a tubular former (8), a voice coil (12) carried by the former (8) and disposed within the annular gap (7), a conductive skirted dome (13) supported on the pole upon an insulated support (14), said skirt being disposed within the annular gap (7) whereby, when the voice coil is energized, the conductive skirted dome is inductively coupled with the voice coil, said dome (13) including a central opening (15) and the insulated support (14) comprising a first gasket providing a plurality discrete, separated and spaced apart, positions of support (18), the loudspeaker further comprising a phase plug (16), the phase plug (16) having a stem attached to the pole (6) through the central opening (15) with a clearance, and a second gasket (27) disposed between the underside of the phase plug (16) and the top of the dome (13).

10. A loudspeaker (1) according to claim 9 wherein the second gasket (27) is secured to both the phase plug (16) and the dome (13) to secure the dome in position.

11. A loudspeaker according to claim 9, wherein the phase plug (16) includes a horn (20) extending axially and laterally beyond the former (8) and including an annular recess (25) allowing room for movement of the former (8).

12. A loudspeaker (1) according to claim 9 wherein the dome (13) comprises an electrically conductive skirt and an insulated domed portion to generate high frequency sound, the insulated domed portion of the dome being selected from: a non-electrically conductive material, or an electrically conductive material insulated from the skirt.

13. A loudspeaker according to claim 9, wherein the phase plug includes a horn (20) extending beyond the former, the horn (20) being integral with the phase plug (16).

14. A loudspeaker according to claim 9, wherein the dome (13) comprises an electrically conductive skirt and an insulated domed portion to generate high frequency sound.

15. A loudspeaker (1) comprising a pole (6), a surrounding magnet (3) defining an annular gap (7) with the pole, a tubular former (8), a voice coil (12) carried by the former (8) and disposed within the annular gap (7), a conductive skirted dome (13) supported on the pole upon an insulated support (14), said skirt being disposed in the annular gap (7) whereby, when the voice coil is energized the conductive skirted dome is inductively coupled with the voice coil, the insulated support comprising a shaped insulating first gasket (14) providing a plurality of discrete, separated and spaced apart, arcuate positions of support (18) for the dome (13), the loudspeaker further comprising a phase plug (16) attached to the pole by means of a stem passing through an opening in the dome, the phase plug having a second gasket (27) disposed between the underside of the phase plug (16) and the top of the dome (13), and the phase plug (16) including a horn (20) extending axially and laterally beyond the former (8) and having an annular recess (25) for allowing room for movement of the former.

* * * * *

UNITED STATES PATENT AND TRADEMARK OFFICE

CERTIFICATE OF CORRECTION

PATENT NO. : 5,602,930

DATED : February 11, 1997

INVENTOR(S) : Roger N. Walton

It is certified that error appears in the above-identified patent and that said Letters Patent are hereby corrected as shown below: On the title page: ITEM

"[73] Assignee: Harman-Motive Limited" is amended to
--[73] Assignee: Harman International Industries Limited--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*